United States Patent [19]

Kanno et al.

[11] Patent Number: 4,721,087

[45] Date of Patent: Jan. 26, 1988

[54] FUEL SUPPLY CONTROL APPARATUS FOR INTERNAL COMBUSTION ENGINE

[75] Inventors: Yoshiaki Kanno; Katsuya Nakamoto; Jiro Sumitani, all of Himeji, Japan

[73] Assignee: Mitsubishi Denki Kabushiki Kaisha, Tokyo, Japan

[21] Appl. No.: 29,609

[22] Filed: Mar. 24, 1987

[30] Foreign Application Priority Data

Apr. 18, 1986 [JP] Japan ..... 61-90927

[51] Int. Cl.[4] ..... F02D 41/18

[52] U.S. Cl. ..... 123/488; 123/478; 123/494

[58] Field of Search ..... 123/478, 488, 494

[56] References Cited

U.S. PATENT DOCUMENTS 4,411,235 10/1983 Shinoda et al. ..... 123/494 X
4,412,520 11/1983 Mitsuyasu et al. ..... 73/118.1 X
4,550,705 11/1985 Nagano et al. ..... 123/488

FOREIGN PATENT DOCUMENTS 10744 1/1984 Japan ..... 123/494
60-025 12/1985 Japan .

*Primary Examiner*—Tony M. Argenbright
*Attorney, Agent, or Firm*—Burns, Doane, Swecker & Mathis

[57] ABSTRACT

A fuel supply control apparatus for an internal combustion engine, which, when an air quantity detected at a predetermined crank angle of the internal combustion engine is represented by Qa and the (n−1)th air intake quantity and the next (n)th air intake quantity of the internal combustion engine at the predetermined crank angles thereof by Qe(n−1) and Qe(n) respectively, judges the optimum fuel supply quantity of the internal combustion engine by an equation: $Qe(n)=K\cdot Qe(n-1)+(1-K)\cdot Qa$ with filtering using the filter constant K, and which varies the filter constant K corresponding to an operating condition of the internal combustion engine, for example reduces K during idling, so that the fuel supply quantity can be controlled most suitably during idling and loaded operation.

2 Claims, 25 Drawing Figures

FUEL SUPPLY CONTROL APPARATUS FOR INTERNAL COMBUSTION ENGINE

BACKGROUND OF THE INVENTION

1. Field of the Invention

The present invention relates to a fuel supply control apparatus for an internal combustion engine, and more particularly to a fuel supply control apparatus which detects by an air flow sensor an air intake quantity into the internal combustion engine to thereby control an optimum fuel supply to the internal combustion engine by means of optimal filtering on the basis of the detected value of air intake quantity.

2. Description of the Prior Art

For fuel control of the internal combustion engine, an air flow sensor (to be hereinafter called AFS) is provided at the upstream side of a throttle valve so that an air intake quantity per one suction is obtained by the information from the AFS and the number of revolutions of the engine, thereby controlling the fuel supply quantity on the basis of the above data.

In a case where the AFS is disposed at the upstream side of the throttle valve in the air intake passage so as to detect an air intake quantity into the internal combustion engine, the AFS, when the throttle valve abruptly opens, will measure even the quantity of air which does not reach the engine, being filled in the intake passage between the throttle valve and the engine. Therefore, the AFS measures an air quantity larger than that actually taken into the internal combustion engine so that a fuel quantity is controlled as it is, thereby creating inconvenience of resulting in overrich fuel. Hence, conventionally, when the output of AFS, that is, the detected air intake quantity at a predetermined crank angle, is represented by AN(t), the (n−1)th and (n)th air intake quantities into the internal combustion engine at the predetermined crank angle thereof are represented by AN(n−1) and AN(n) respectively, and the filter constant is represented by K, AN(n) is given in the following equation:

$$AN(n)=K1\times AN(n-1)+K2\times AN(t).$$

Hence, the obtained value of AN(n) may be used to carry out the fuel control, which has smoothened the air intake quantity at every predetermined crank angle to thereby perform proper fuel control.

The aforesaid proposal of the optimal filter is disclosed in the Japanese Patent Publication No. 60-60025 (1985).

In the aforesaid conventional apparatus, however, a delay of computation of the air quantity occurs by more, than duration of one suction because of the compensating computation of the air intake quantity, thereby varying an air fuel ratio to increase variation in the number of revolutions of engine during the idling, for example. Namely, in FIG. 1, (a) shows the number of revolutions of the engine: Ne, (b) shows intake pipe pressure, (c) shows a driving pulse width for an injector, and (d) shows the air fuel ratio. When the number of revolutions Ne varies, pressure in the intake pipe affected by a volume thereof somewhat delays in variation. The air quantity taken in the internal combustion engine also lags behind the number of revolutions of the engine Ne in comparison with the intake pipe pressure, and, when corrected by the aforesaid equation, further lags behind the intake pipe pressure, and the pulse width signal for the injectors lags as shown by (e) in FIG. 1(*c*). At this time, the air fuel ratio, as shown by (g) in FIG. 1, becomes rich under the influence of a surge tank accompanied by a rise of the number of revolutions of the engine and by a delay in computation, in other words, the ratio becomes smaller than 14.7. Therefore, an engine torque increases from the characteristic of internal combustion engine as shown in FIG. 2 and the number of revolutions Ne of the engine further rises. The,, the number of revolutions Ne of engine, when reaching the upper limit, turns to lowering, at which time the influence of the surge tank or the delay in computation makes the air fuel ratio thinner (larger than 14.7) to decrease the engine torque, thus further decreasing the number of revolutions Ne of the engine.

Thus, conventionally, the air fuel ratio varies in the direction of promoting the variation in the number of engine revolutions, thereby creating the problem in that the operating condition of the engine becomes very unstable.

SUMMARY OF THE INVENTION

In order to solve the above problem the present invention has been designed.

A first object thereof is to provide a fuel supply control apparatus for an internal combustion engine, which can properly control the air fuel ratio even during the transition of variation of air intake quantity.

A second object of the invention is to provide a fuel supply control apparatus for an internal combustion engine, which can maintain the optimum fuel supply when not only loaded but also idling.

The fuel supply control apparatus for an internal combustion engine of the invention being provided with a throttle valve for adjusting an air intake quantity of said internal combustion engine to be controlled, an air flow sensor for detecting the air intake quantity adjusted by said throttle valve, an AN detecting means which detects the output of said air flow sensor at a predetermined crank angle of said internal combustion engine to thereby detect a ratio of said output to the number of revolutions of said internal combustion engine, an AN computing means which, when the detecting result of said AN detecting means is represented by Qa, the (n−1)th air intake quantity and (n)th air intake quantity by said internal combustion engine at the predetermined crank angles thereof are represented by Qe(n−1) and Qe(n) respectively, and the filter constant is represented by K, computes Qe(n) from the following equation:

$$Qe(n)=K\cdot Qe(n-1)+(1-K)\cdot Qa$$

and a control means for controlling a fuel supply quantity to said internal combustion engine on the basis of the output Qe(n) of said AN computing means, is characterized in that said filter constant K is varied corresponding to an operating condition of said internal combustion engine.

The above and further objects and features of the invention will more fully be apparent from the following detailed description with accompanying drawings.

DESCRIPTION OF THE PREFERRED EMBODIMENT

Next, an embodiment of a fuel supply control apparatus of the present invention will be described with reference to the drawings.

Figure 3:
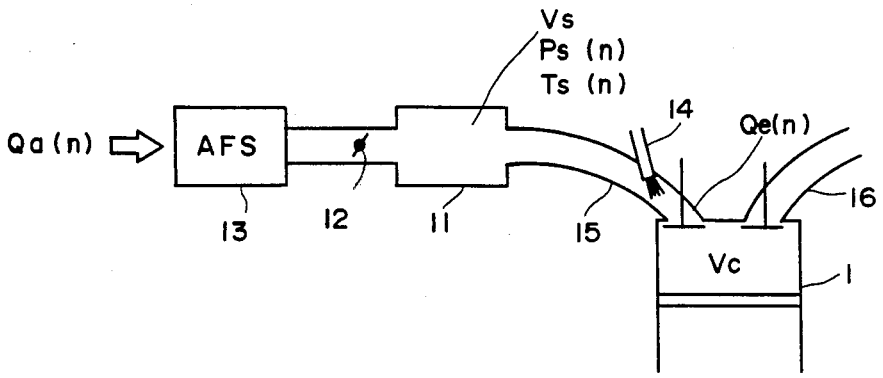
FIG. 3 is a structural view exemplary of an air intake system at the internal combustion engine, FIGS. 4(*a–d*) are a graph of an air intake quantity with respect to a crank angle of the internal combustion engine, FIGS. 5(*a–d*) are a wave form chart showing variation of the air intake quantity during the transition of the internal combustion engine.

FIG. 3 shows a model of an air intake system of an internal combustion engine, in which reference numeral 1 designates the internal combustion engine of a volume Vc per one stroke, sucked air through an air flow sensor (AFS) 13 of a Karman vortex flowmeter, a throttle valve 12, a surge tank 11 and an air intake pipe 15, and is supplied with fuel by an injector 14, a volume from the throttle valve 12 to the internal combustion engine 1 being represented by Vs. 16 designates an exhaust pipe.

Figure 4:
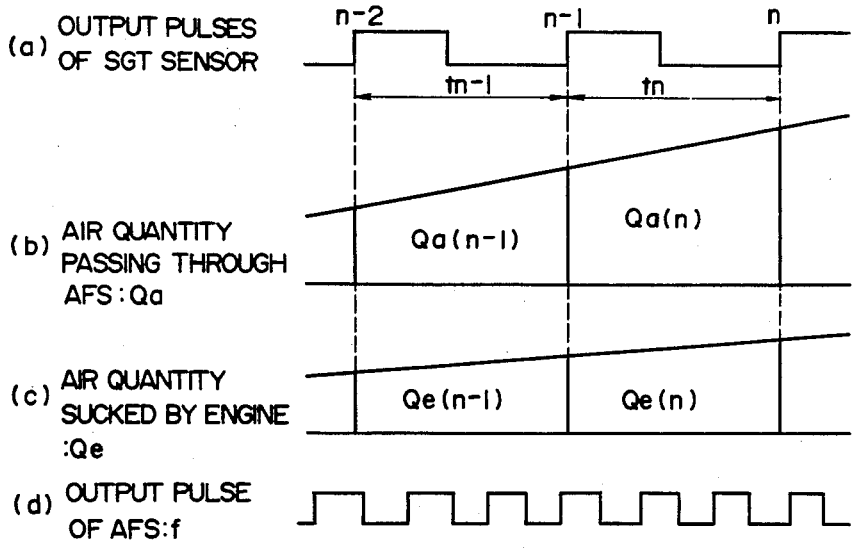

FIG. 4 shows the relation between the air intake quantity and the predetermined crank angle at the internal combustion engine 1, in which FIG. 4(*a*) shows the predetermined crank angle of the internal combustion engine 1 (to be hereinafter called the signal timing (SGT) indicated by an SGT sensor 17, FIG. 4(*b*) shows an air quantity Qa passing through the AFS 13, FIG. 4(*c*) shows an air quantity sucked by the internal combustion engine 1, and FIG. 4(*d*) shows an output pulse f of the AFS 13. The duration from the (n−2)th leading edge to the (n−1)th leading edge at the SGT is represented by t(n−1), the duration from the (n−1)th leading edge to the (n)the leading edge by t(n), air intake quantity passing through the AFS 13 during the durations t(n−1) and t(n) are represented by Qa(n−1) and Qa(n) respectively, air intake quantity by the internal combustion engine 1 during the durations t(n−1) and t(n) are represented by Qe(n−1) and Qe(n). Furthermore, an average pressure and an average intake-air temperature within the surge tank 11 during the durations t(n−1) and t(n) are represented by Ps(n−1), Ps(n), Ts(n−1) and Ts(n) respectively, where, for example, Qa(n−1) corresponds to the number of output pulse f of AFS 13 during the duration t(n−1). Also, assuming that a rate of change of the intake-air temperature is small so as to be Ts(n−1)≈Ts(n) and the charging efficiency of internal combustion engine is constant, the following equations are obtained:

$$Ps(n-1)\cdot Vc = Qe(n-1)\cdot R\cdot Ts(n) \quad (1)$$

$$Ps(n)\cdot Vc = Qe(n)\cdot R\cdot Ts(n) \quad (2)$$

where R is the constant. When an air quantity filled in the surge tank 11 and air intake pipe 15 during the duration t(n) is represented by ΔQa(n), the following equation is given:

$$\Delta Qa(n) = Qa(n) - Qe(n) = Vs\cdot\frac{1}{R\cdot Ts(n)}\times(Ps(n) - Ps(n-1)) \quad (3)$$

When a pressure difference Ps(n)−Ps(n−1) is obtained from the equations (1) and (2) and substituted into the equation (3), the following equation is obtained:

$$Qe(n) = \frac{1}{1+\frac{Vc}{Vs}}\cdot Qe(n-1) + \left(1 - \frac{1}{1+\frac{Vc}{Vs}}\right)\cdot Qa(n). \quad (4)$$

Accordingly, the air quantity Qe(n) taken-in by the internal combustion engine 1 for the duration t(n) can be computed by the equation (4) on the basis of the air quantity Qa(n) passing through the AFS 13. Here, assuming Vc=0.5 liter and Vs=2.5 liters, the following equation is given:

$$Qe(n) = 0.83\times Qe(n-1) + 0.17\times Q(n) \quad (5)$$

Figure 5:
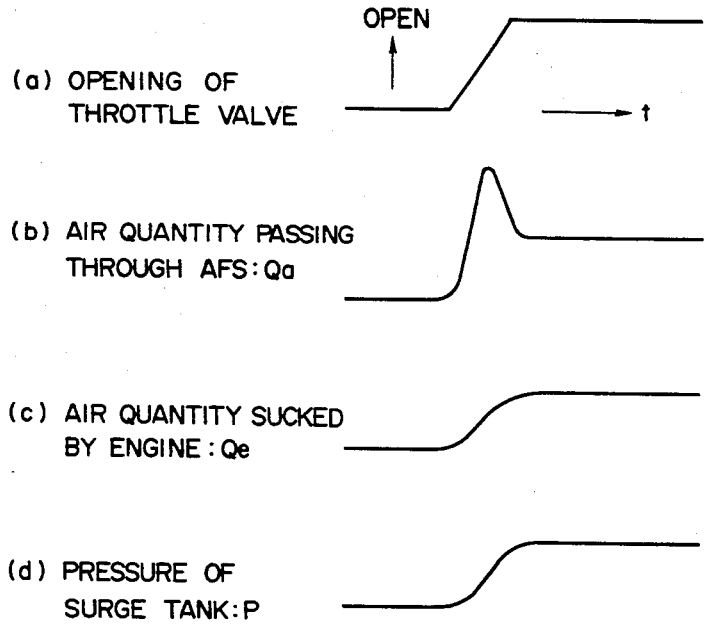

Next, FIG. 5 shows a condition of keeping the throttle valve 12 open, in which the FIG. 5 (*a*) shows the opening of the throttle valve 12, FIG. 5 (*b*) shows the air intake quantity Qa, which overshoots when the throttle valve 12 is open, FIG. 5 (*c*) shows the air quantity Qe taken-in by the internal combustion engine 1 and corrected by the equation (4), and FIG. 5(*d*) shows pressure P in the surge tank 11.

Figure 6:
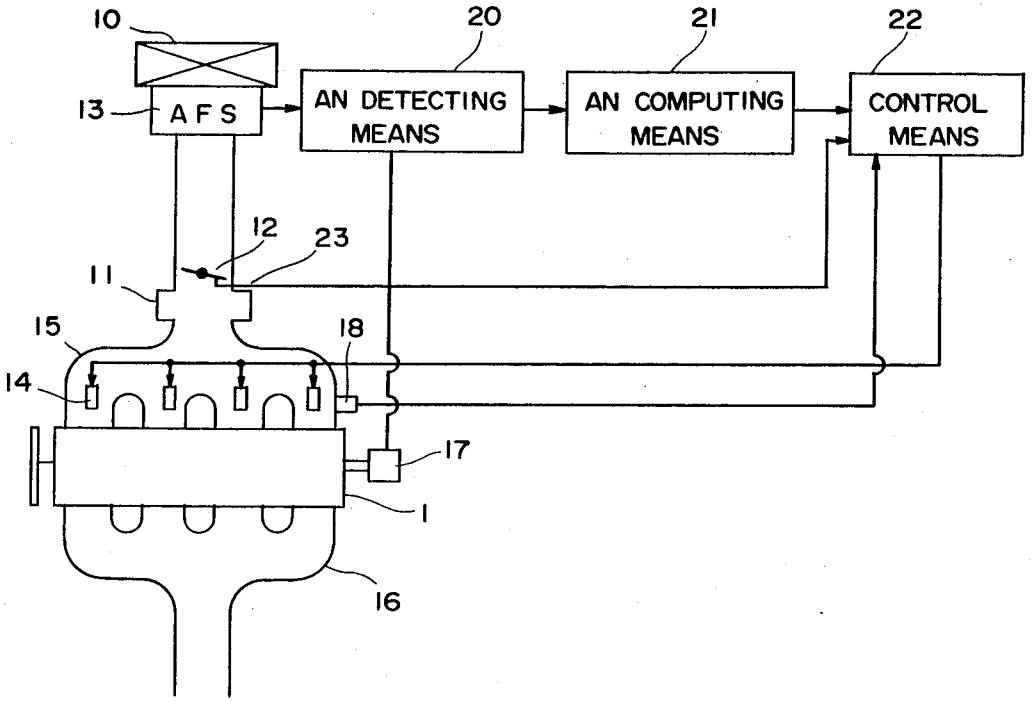
FIG. 6 is a block diagram of the fuel supply apparatus of the invention.

FIG. 6 is a block diagram of the fuel supply control apparatus for the internal combustion engine of the invention, in which reference numeral 10 designates an air cleaner disposed at the upstream side of the AFS 13, the AFS 13 outputting pulse as shown in FIG. 4(*d*) corresponding to an air quantity taken in the internal combustion engine 1, and an SGT sensor 17 outputs pulse (for example, at a crank angle of 180° from the leading edge of pulse to the next leading edge thereof) as shown in FIG. 4(*a*) corresponding to the revolution of internal combustion engine 1, 20 designates an AN detecting means (where an air flow rate is represented by A and the engine speed by N so that AN is a ratio of air intake quantity to the number of revolution of the engine) for counting the output pulse number of the AFS 13 entering between the predetermined crank angles of the internal combustion engine 1, 21 designates an AN computing means which carries out computation similar to the equation (5) so as to obtain from the output of the AN detecting means 20 the pulse number equivalent to the output of the AFS 13 corresponding to the air quantity Qe deemed to be taken in the internal combustion engine 1, and 22 designates a control means which is given outputs from the AN computing means 21, a water temperature sensor 18 (a thermistor, for example) for detecting a cooling water temperature for the internal combustion engine 1, and an idle switch 23 for detecting the idling condition, so as to control by these outputs a driving time of the injectors 14 corresponding to the air quantity taken in the internal combustion engine, thereby controlling an quantity of fuel supplied thereto.

Figure 7:
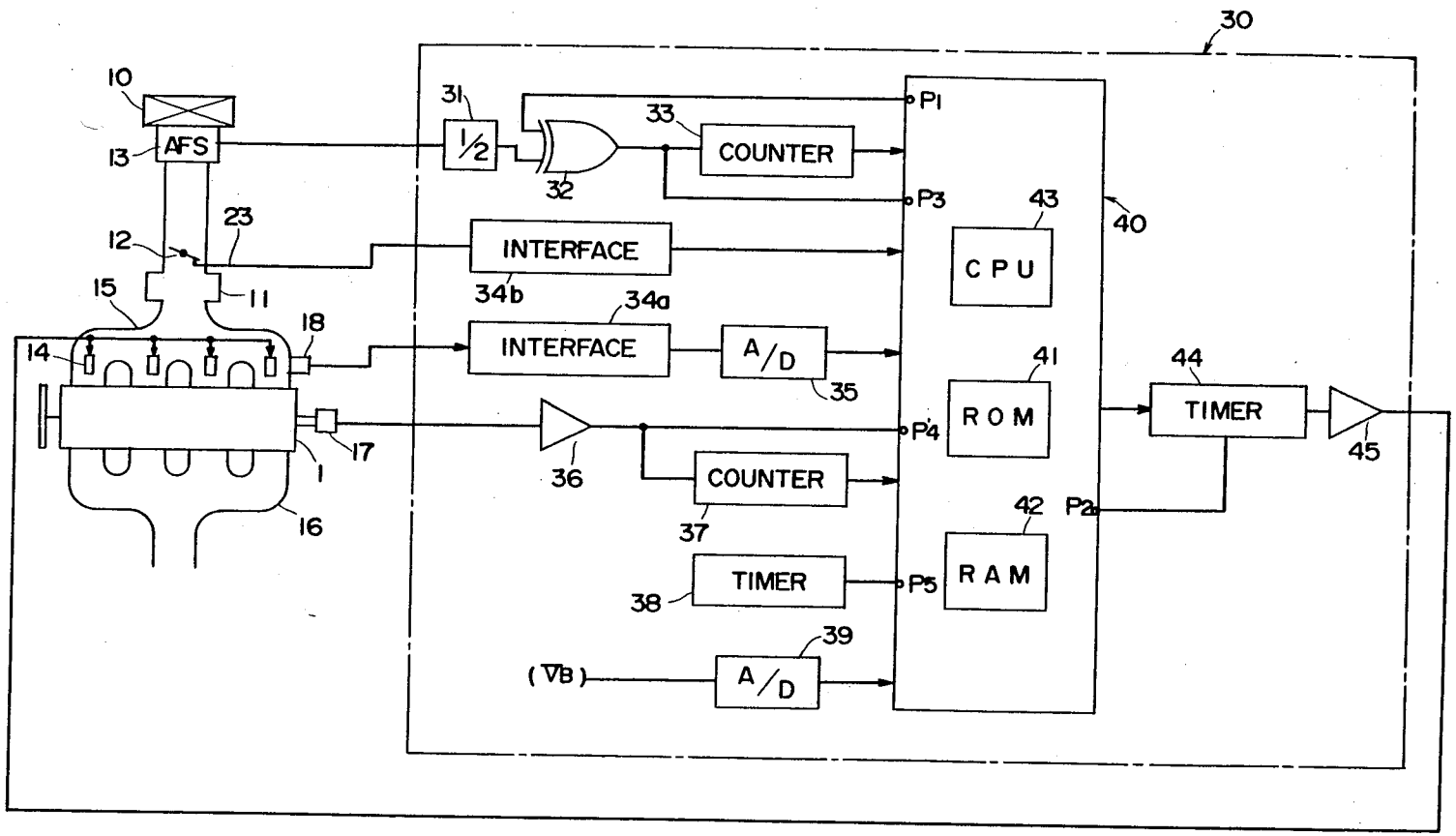
FIG. 7 is a detailed block diagram of the same, showing concrete construction thereof, FIGS. 8, 10, 11(*a*), and 11(*b*) are flow charts showing operation of the same.

FIG. 7 is a block diagram of further concrete construction of the embodiment of the present invention, in which reference numeral 30 designates a control system being given output signals from the AFS 13, the water temperature sensor 18, the idle switch 23 and the SGT sensor 17, and controls the four injectors 14 provided at the respective cylinders of internal combustion engine 1, the control system 30 having functions corresponding to the AN detecting means 20, the AN computing means 21 and the control means 22 and being materialized with a microcomputer 40 having a ROM 41, a RAM 42 and a CPU 43. Also, reference numeral 31 designates a ½ frequency divider connected to the output of the AFS 13, 32 designates an exclusive OR gate which introduces at one input terminal the output of the ½ frequency divider 31 and connects at the other input terminal with an input port P1 at the microcomputer 40 and at an output terminal with a counter 33 and an input port P3 at the microcomputer 40, **34*a* designates an interface being connected between the water temperature sensor 18 and an A/D converter 35, 34b designates an interface being connected between the idle switch 23 and the microcomputer 40, 36 designates a waveform shaping circuit which introduces therein an output of the SGT sensor 17, the output of the waveform shaping circuit 36 being given to an interrupt input port P4 at the microcomputer 40 and a counter 37, 38 designates a timer connected to an interrupt input port P5 at the microcomputer 40, 39 designates an A/D converter for A/D-converting voltage (VB) of a battery (not shown) so as to output the A/D converted voltage to the microcomputer 40, and 44 designates a timer provided between the microcomputer 40 and a driver 45, the output of the driver 45 being connected to the respective injectors 14**.

Next, explanation will be given on operation of the fuel supply apparatus of the invention constructed as the above-mentioned. The output of the AFS 13 is divided by the ½ frequency divider 31 and introduced into the counter 33 through the exclusive OR gate 32 controlled by microcomputer 40, the counter 33 measuring the duration of the trailing edge of the output from the gate 32. The trailing edge of the gate 32 is introduced into the interrupt input port P3 at the microcomputer 40 and the interruption is carried out every cycle of the output pulse of the AFS 13 or at every ½ divided frequency thereof, so that the microcomputer 40 measures the duration of the output pulse of the AFS 13 counted by the counter 33. The output of water temperature sensor 18 is converted into voltage by the interface **34*a* and converted into a digital value by A/D converter every predetermined time so as to be fetched in the microcomputer 40. The output of the SGT sensor 17 is given into the interrupt input port P4 of the microcomputer 40 and the counter 37 through the waveform shaping circuit 36. The output of the idle switch 23 is introduced into the microcomputer 40 through the interface 34*b*. The microcomputer 40 carries out the interruption at every leading edge of the output signal of the SGT sensor 17 to thereby detect from the output of the counter 37 the duration of leading edge of the output signal of the SGT sensor 17. The timer 38 generates an interrupt signal every predetermined time and gives it to the interrupt input port P5 at the microcomputer 40. The A/D converter 39 A/D-converts voltage (VB) of the battery (not shown), and the data of the battery voltage (VB) is fetched into the microcomputer 40 every predetermined time. The timer 44 is preset by the microcomputer 40 and triggered from the output port P2 thereof, thereby outputting pulse of a predetermined width. Hence, the output pulse drives the injectors 14 through the driver 45**.

Figure 8:
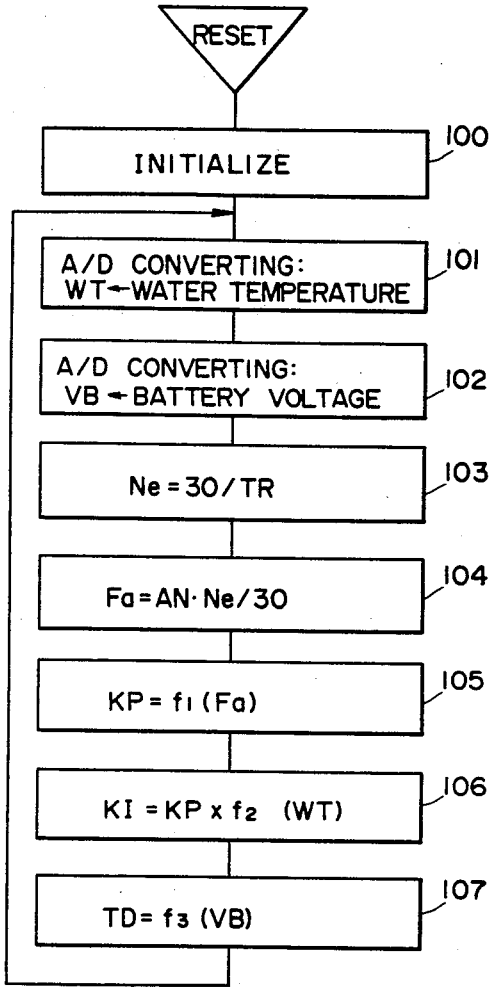

Next, explanation will be given on the control operation of a CPU 43 with reference to the flow charts in FIGS. 8, 10 and 11. At first, the main program of the CPU 43 is shown in FIG. 8.

The CPU 43, when given a reset signal, initializes the RAM 42 and input and output ports P1 through P5 (at the step 100), A/D converts the output of the water temperature sensor 18 and stores it as WT in the RAM 42 (step 101), A/D-converts battery voltage to store it as VB in the RAM 42 (step 102), computes 30/TR from the duration TR of output pulse of the SGT sensor 17 to thereby compute the number of revolutions Ne of the engine 1 (step 103), and further computes AN·Ne/30 from the load data AN to be discussed below and the number of revolutions Ne of the engine, thereby obtaining the output frequency Fa of the AFS 13 (step 104).

Figure 9:
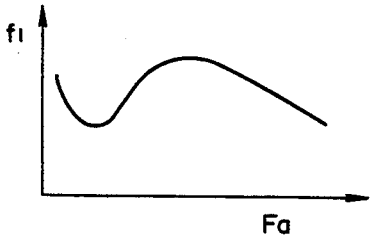
FIG. 9 is a graph showing the relation between the basic driving time conversion factor and the AFS output frequency, and FIGS. 12(*a–d*) are a timing chart showing the timing shown in the flow charts in FIGS. 10 and 11.

Also, the CPU 43 computes a reference drive time conversion factor Kp by the output frequency Fa of the AFS 13 on the basis of a factor f1 set with respect to the Fa in the relation as shown in the graph of the FIG. 9 (step 105), corrects the conversion factor Kp by the water temperature data WT and stores in the RAM 42 the corrected factor as a drive time conversion factor KI (step 106), and maps a data table f3 previously stored in the ROM 41 in accordance with the battery voltage data VB and computes a dead time TD to be stored in the RAM 42 (step 107). The processing after the step 107 is repeated in the order from the step 101.

Figure 10:
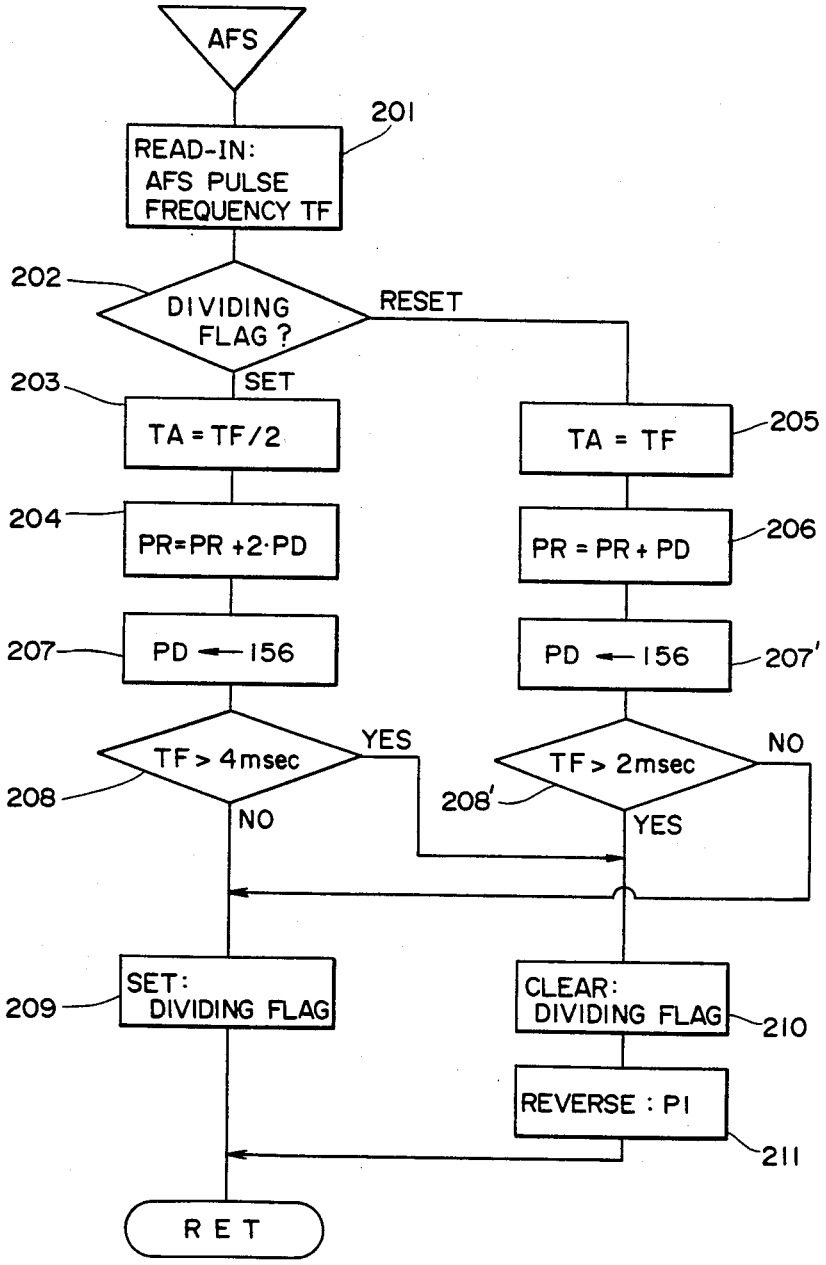

FIG. 10 shows the interrupt processing of the interrupt input port P3, in other words, the interrupt processing with respect to the output signal of the AFS 13. The CPU 43 detects the output TF of the counter 33 and thereafter clears the counter 33 (step 201), the output TF thereof corresponding to the duration of leading edge of the output of the gate 32. Also, the CPU 43, when the dividing flag in the RAM 42 is set (step 202), divides TF in two and stores it as the output pulse duration TA of the AFS 13 in the RAM 42 (step 203), next, adds to the integrating pulse data PR the two-fold residual pulse data PD to make new integrating pulse data PR (step 204), the integrating pulse data PR integrating the pulse number of the AFS 13 outputted for the duration of leading edge of output pulse from the SGT sensor 17 and multiplied by 156 for operation with respect to one pulse of the AFS 13 for the convenience of processing.

When the dividing flag is reset (step 202), the CPU 43 stores in the RAM 42 the duration TF as the output pulse duration TA of the AFS 13 (step 205), adds to the integrating pulse data PR the residual pulse data PD (step 207). In a case where the dividing flag is reset and when TF>2 msec (step 208'), and in a case where the same is set and when TF>4 msec (step 208), the processing is transferred to the step 210, and in a case other than the above, the processing is transferred to the step 209. The CPU 43 sets the dividing flag (step 209), clears it (step 210), and inverts the output signal of the output port P1 (step 211). Accordingly, for the processing (step 209), the signal is given to the interrupt input port P3 at the timing of dividing into half the output pulse of the AFS 13. For the processing (step 210), the signal is given to the interrupt input port P3 at every output pulse of the AFS 13, thereby completing the interruption after the steps 209 and 211.

Figure 11:
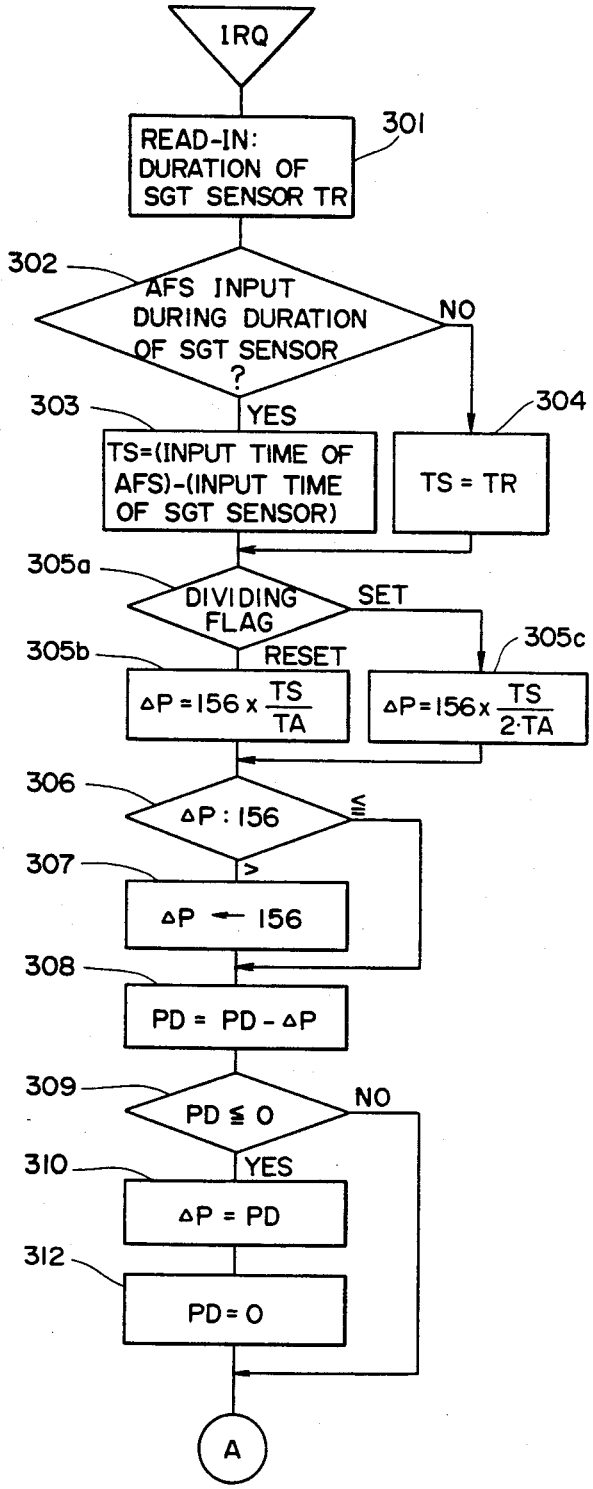
Figure 11B:
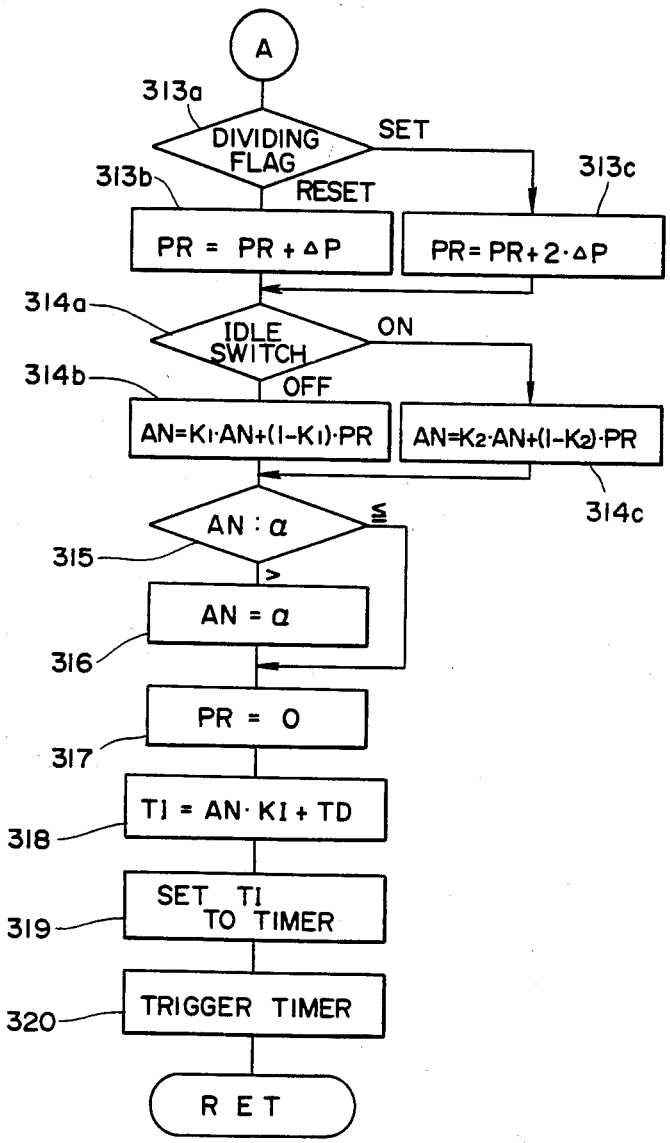

FIG. 11 is a flow chart of the interruption when an interrupt signal is generated from the output of the SGT sensor 17 so as to be given to the interrupt input port P4 of the CPU 43.

The CPU 43 reads out the duration of leading edge of the output signal of the SGT sensor 17 as the timing value by the counter 37, stores it as the duration TR in the RAM 42, and clears the counter 37 at the step 301. Also, the CPU 43, when the output pulse of the AFS 13 is in the duration TR (step 302), computes a time difference $\Delta t = t02 - t01$ between the time t01 of the just preceding output pulse of the AFS 13 and the present interrupt time t02 of the SGT sensor 17, and deems the time difference to be duration Ts (step 303), and when the output pulse of the AFS 13 is not in the duration TR (step 302), deems TR to be Ts (step 304).

It is judged whether the dividing flag is set or not (step 305*a*), so that the CPU 43, when the flag is reset, computes $\Delta P = 156 \times Ts/TA$ (step 305*b*) and, when set, computes $\Delta P = 156 \times Ts/2 \cdot TA$ (step 305*c*), thereby converting the time difference $\Delta t$ into the output pulse data of the AFS 13. In other words, the former output pulse duration of the AFS 13 and the present output pulse duration of the same are assumed to be the same so as to compute the pulse data $\Delta P$.

When the pulse data $\Delta P$ is smaller than 156 (step 306), the processing is transferred to the step 308 and, when larger, clipped to 156 (step 307) and thereafter jumped to the step 308. The CPU 43 substracts the pulse data $\Delta P$ from the residual pulse data PD to obtain the new residual pulse data PD (step 308). When the residual data PD is positive or zero (step 309), the processing is jumped to the step 313*a*, and, when not so, the computed valve of pulse data $\Delta P$ is much larger than the output pulse of the AFS 13, whereby the CPU 43 equalizes the pulse data $\Delta P$ to the residual pulse data PD (step 310) and makes zero the residual pulse data PD (step 312).

The dividing flag is decided as to whether or not it is set (step 313*a*), so that when reset, the CPU 43 adds the pulse data $\Delta P$ to the integrating pulse data PR (step 313*b*), and when set, adds $2 \neq \Delta P$ to PR (step 313*c*), which are deemed to be the new integrating pulse data PR respectively, the updated integrating pulse data PR corresponding to the pulse number deemed to be output from the AFS 13 during the leading edge of the output pulse from the SGT sensor 17. Computation corresponding to the equation (5) is carried out (steps 314*a*, 314*b* and 314*c*). In other word, the CPU 43, when the idle switch 23 is on, decides the idling condition on the basis of the load data AN and integrating pulse data PR computed until the former leading edge of the output signal of the SGT sensor 17, thereby computing $AN = K2 \cdot AN + (1 - K2) \cdot PR$, and, when the idle switch 23 is off, the CPU 43 computes $AN = K1 \cdot AN + (1 - K1)PR$ $(K1 > K2)$ so that the results of computation are used as the present new load data AN.

Here, K1 and K2 are the filter constants respectively, the filter constant K1, when not-idling, is judged on the basis of the factor $$\frac{1}{1 + \frac{Vc}{Vs}}$$

in the equation (4), and the filter constant K2, when idling, is judged to reduce variation of the number of revolutions of engine during the idling, on the basis of the extra experimental results or the like.

Also, the load data AN is obtained as the result of filter-processing the detected value Qa of AN detecting means. Further concretely, the load data AN corresponds to the equation (5).

Next, the CPU 43, when the load data AN is larger than a predetermined value $\alpha$ (step 315), clips AN to $\alpha$, so that, even when the internal combustion engine 1 is fully open, the load data AN is restrained from exceeding the actual value (step 316). Then, the CPU 43 clears the integrating pulse data PR (step 317), thereafter computes from the load data AN, previously obtained driving time conversion factor K1, and dead time TD, the driving time data $T1 = AN \int K1 + TD$ for driving the injectors 14 (step 318), sets the driving time data T1 at the timer 43 (step 319), and triggers the timer 43 (step 320). Hence, the four injectors 14 are driven simultaneously, thereby finishing the interruption.

Figure 12:
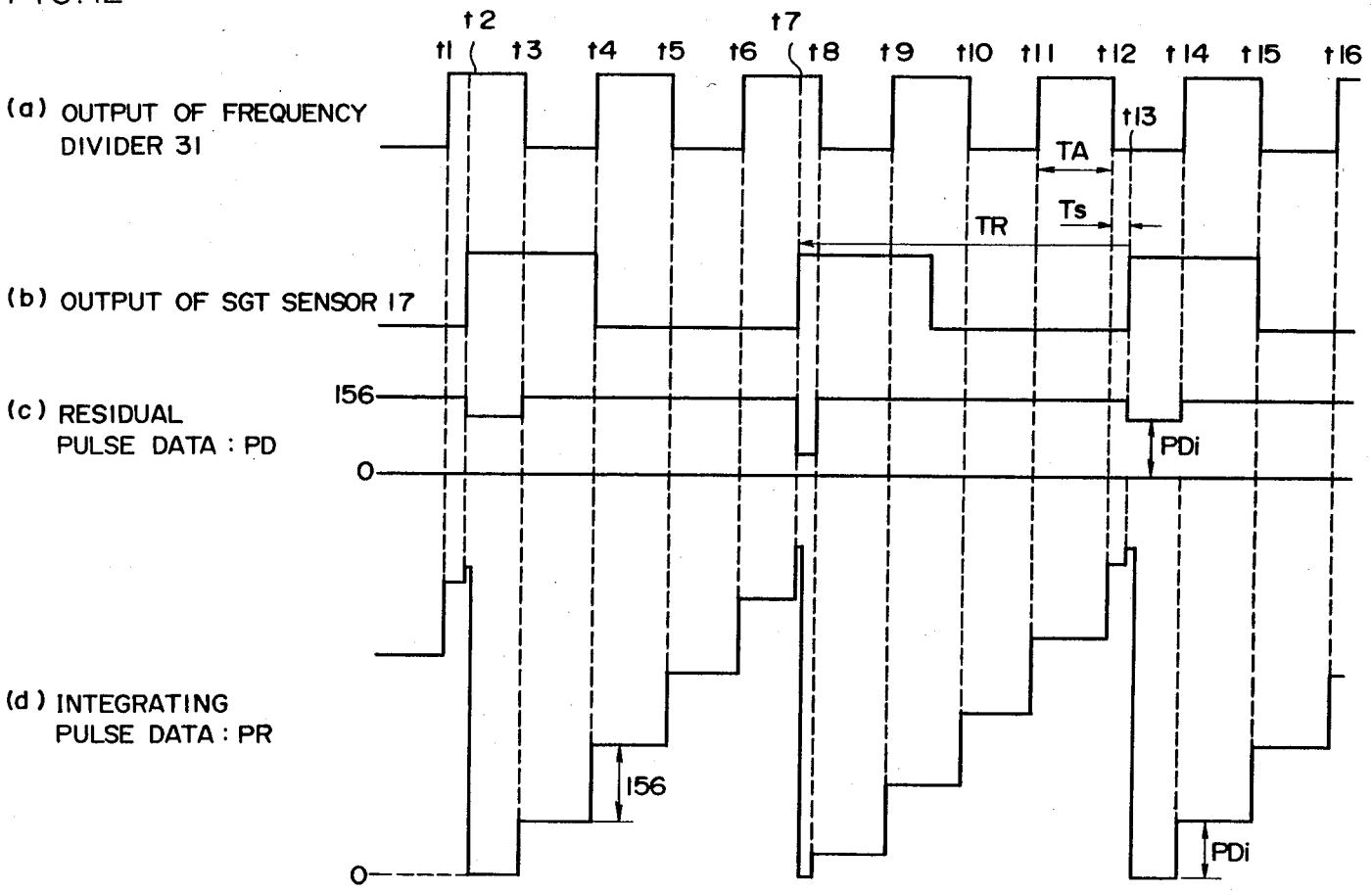

FIG. 12 shows the timing when the dividing flag is cleared in the processing shown in FIGS. 8, 10 and 11. FIG. 12(*a*) shows an output of a frequency divider 31. FIG. 12 (*b*) shows an output of the SGT sensor 17, FIG. 12(*c*) shows the residual pulse data PD which is set to 156 at every, leading edge and trailing edge (in other word, the leading edge of output pulse of the AFS 13) of the frequency divider 31 and changed to the computation result of, for example, $PDi = PD - 156 \times Ts/TA$ at every leading edge of the output signal of the SGT sensor 17 (corresponding to the processings of the step 305 through the step 312 in FIG. 11), and FIG. 12(*d*) shows variation in the integrating pulse data PR and the mode of integrating the residual pulse data PD at every leading or trailing edge of frequency divider 31.

Figure 1:
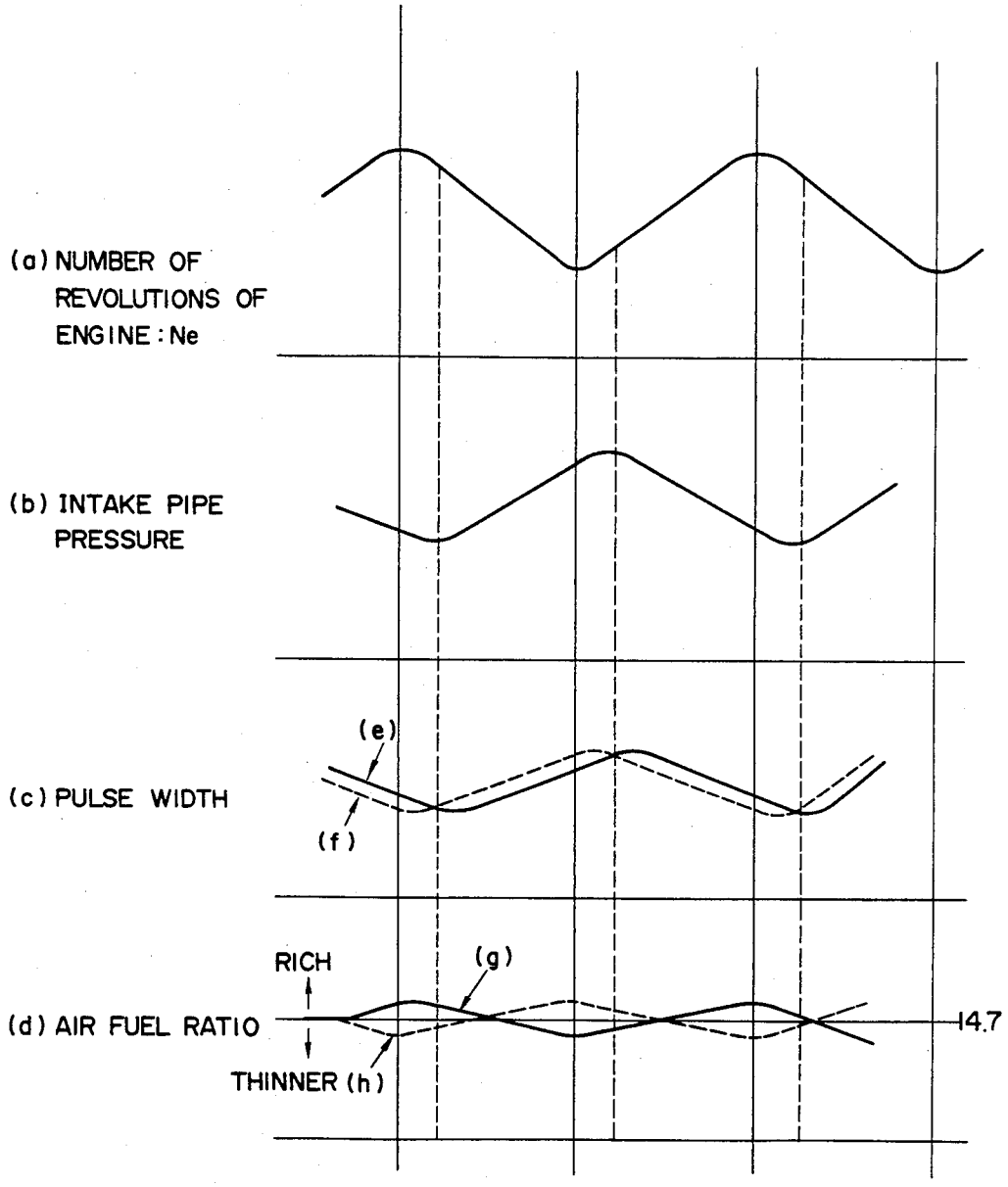
FIGS. 1(*a–d*) one a wave form chart of operation of an internal combustion engine controlled by a fuel supply control apparatus of the present invention.
Figure 2:
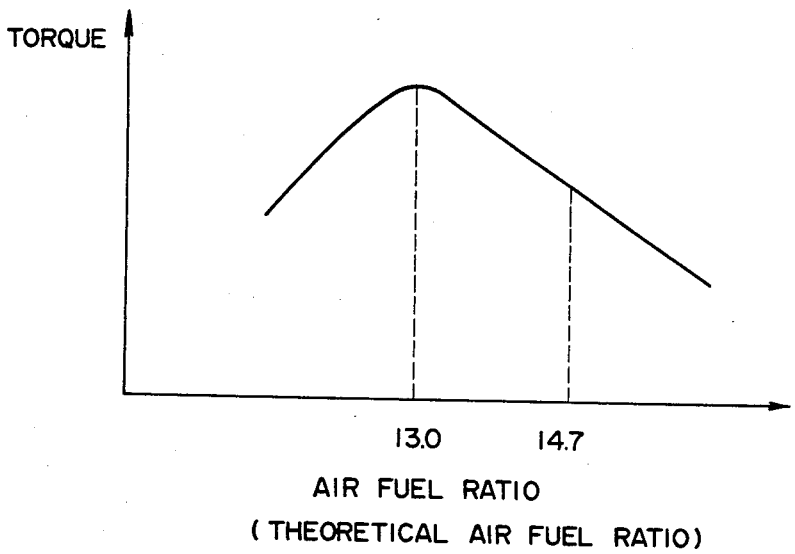
FIG. 2 is a characteristic view of the internal combustion engine.

In the aforesaid embodiment of the invention, the value of filter constant K in the equation of correction for the air intake quantity into the internal combustion engine, as above-mentioned, is reduced during the idling in comparison with the not-idling, thereby enabling a delay in air intake quantity to be reduced and the phase to lead. Hence, the pulse width signal leads as shown by f in FIG. 1, so that the air fuel ratio, as shown by h in FIG. 1, can be made thinner when the number of revolutions Ne of the engine is larger and richer when Ne is smaller, whereby the number of revolutions Ne of the engine is not promoted of variation therein and can be stable.

In addition, in the afore said embodiment, the output pulses of the AFS 13 between the leading edges of the signal from the SGT sensor 17 are counted, which may alternatively be counted between the trailing edges, or the output pulse number of the AFS 13 for several durations of the signal from the SGT sensor may be counted. Also, the output pulse number multiplied by the constant corresponding to the output frequency of the AFS 13 may be counted. Furthermore, it is similarly effective to detect the crank angle not by the SGT sensor 17 but by an ignition signal for the internal combustion engine 1. Also, the number of revolutions of engine or the condition of vehicle stop may be added to the decision of the idling. The filter constant K may further be corrected by the number of revolutions of engine, load condition, gear ratio and the like.

As seen from the above, the fuel supply control apparatus of the present invention is adapted to correct the air intake quantity to the internal combustion engine on the basis of the equation of correction, thereby enabling the proper air fuel ratio to be controlled. Moreover, the filter constant K in the correction equation is adapted to change corresponding to the operating condition of the engine, thereby enabling safe operation of the engine even when idling.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A fuel supply control apparatus for an internal combustion engine, being provided with a throttle valve for adjusting an air intake quantity of said internal combustion engine to be controlled, an air flow sensor for detecting the air intake quantity adjusted by said throttle valve, an AN detecting means which detects the output of said air flow sensor at a predetermined crank angle of said internal combustion engine to thereby detect a ratio of said output to the number of revolutions of said internal combustion engine, an AN computing means which, when the detecting result of said AN detecting means is represented by Qa, the (n−1)th air intake quantity and (n)th air intake quantity by said internal combustion engine at the predetermined crank angles thereof are represented by Qe(n−1) and Qe(n) respectively, and the filter constant is represented by K, computes Qe(n) from the following equation:

$$Qe(n)=K\cdot Qe(n-1)+(1-K)\cdot Qa$$

and a control means for controlling a fuel supply quantity to said internal combustion engine on the basis of the output Qe(n) of said AN computing means, is characterized in that said filter constant K is varied corresponding to an operating condition of said internal combustion engine.

2. A fuel supply control apparatus for an internal combustion engine as set forth in claim 1, wherein said filter constant K is made to be relatively small when said internal combustion engine is idling.

* * * * *